US010307982B2

(12) United States Patent
Adams et al.

(10) Patent No.: US 10,307,982 B2
(45) Date of Patent: Jun. 4, 2019

(54) APPARATUS AND METHOD FOR CUTTING, PRINTING OR EMBOSSING

(71) Applicant: AB GRAPHIC INTERNATIONAL LTD, Bridlington (GB)

(72) Inventors: Mike Adams, Bridlington (GB); Phil Wrack, Bridlington (GB)

(73) Assignee: AB GRAPHIC INTERNATIONAL LTD, Bridlington (GB)

( * ) Notice: Subject to any disclaimer, the term of this patent is extended or adjusted under 35 U.S.C. 154(b) by 0 days.

(21) Appl. No.: 15/575,291

(22) PCT Filed: May 19, 2016

(86) PCT No.: PCT/GB2016/000102
§ 371 (c)(1),
(2) Date: Nov. 17, 2017

(87) PCT Pub. No.: WO2016/193650
PCT Pub. Date: Dec. 8, 2016

(65) Prior Publication Data

US 2018/0154601 A1 Jun. 7, 2018

(30) Foreign Application Priority Data

Jun. 2, 2015 (GB) ..... 1509471.7

(51) Int. Cl.
*B31B 50/00* (2017.01)
*B26D 5/00* (2006.01)
(Continued)

(52) U.S. Cl.
CPC ..... *B31B 50/006* (2017.08); *B26D 1/405* (2013.01); *B26D 5/32* (2013.01); *B26F 1/384* (2013.01);
(Continued)

(58) Field of Classification Search
None
See application file for complete search history.

(56) References Cited

U.S. PATENT DOCUMENTS 3,188,948 A 6/1965 Fischer et al.
4,541,335 A 9/1985 Tokuno et al.
(Continued)

FOREIGN PATENT DOCUMENTS

CN 203542716 4/2014
DE 635364 9/1936
(Continued)

OTHER PUBLICATIONS

Examination Report dated Jan. 20, 2017, Examination Report in corresponding British Patent Application; GB1509471.7, dated Jan. 20, 2017; 5 pages.
(Continued)

*Primary Examiner* — Linda L Gray
(74) *Attorney, Agent, or Firm* — Lempia Summerfield Katz LLC

(57) ABSTRACT

The invention relates to an apparatus (10, 80) and method (160) for cutting, printing or embossing a continuous sheet (26) of material. The apparatus (10, 80) comprising a tool element (12), at least two anvils 14, 16 which are co-operable with the tool element (12), and a phase adjustment device (24). The tool element (12) is configured to have a constant surface speed during operation of the apparatus (10, 80). The apparatus (10, 80) is adapted to receive the continuous sheet (26) at a constant speed into the apparatus (10, 80), and being adapted to output the continuous sheet (26) at a constant speed from the apparatus (10, 80). The phase adjustment device (24) is operable to adjust a speed of the continuous sheet (26) within the apparatus (10, 80) in order to adjust a phase of alternate parts of the continuous sheet
(Continued)

(26) to be cut, printed or embossed by each anvil (14, 16) as it co-operates with the tool element (12).

10 Claims, 5 Drawing Sheets

(51) Int. Cl.

| | |
|---|---|
| ***B26D 1/00*** | (2006.01) |
| ***B26F 1/00*** | (2006.01) |
| ***B41F 13/00*** | (2006.01) |
| ***B41F 19/00*** | (2006.01) |
| ***B65H 37/00*** | (2006.01) |
| ***B26D 5/32*** | (2006.01) |
| ***B26D 1/40*** | (2006.01) |
| ***B26F 1/38*** | (2006.01) |
| ***B41F 13/02*** | (2006.01) |
| ***B41F 13/56*** | (2006.01) |
| ***B41F 19/06*** | (2006.01) |
| ***B31F 1/08*** | (2006.01) |
| ***B31B 50/88*** | (2017.01) |
| ***B31B 50/14*** | (2017.01) |
| ***B31B 50/25*** | (2017.01) |
| ***B41F 19/02*** | (2006.01) |
| ***B65H 37/02*** | (2006.01) |

(52) U.S. Cl.

CPC ..... *B31B 50/146* (2017.08); *B31B 50/256* (2017.08); *B31B 50/88* (2017.08); *B31F 1/08* (2013.01); *B41F 13/025* (2013.01); *B41F 13/56* (2013.01); *B41F 19/008* (2013.01); *B41F 19/02* (2013.01); *B41F 19/062* (2013.01); *B65H 37/02* (2013.01); *B31F 2201/0779* (2013.01)

(56) References Cited

U.S. PATENT DOCUMENTS

| | | | |
|---|---|---|---|
| 4,688,485 | A | 8/1987 | Tison |
| 4,701,235 | A | 10/1987 | Mitsam |
| 4,802,949 | A | 2/1989 | Mitsam |
| 9,114,641 | B2 | 8/2015 | Kerpe |
| 2012/0060709 | A1 | 3/2012 | Mathea |

FOREIGN PATENT DOCUMENTS

| | | |
|---|---|---|
| DE | 2139652 | 2/1973 |
| EP | 0089494 | 9/1983 |
| EP | 1344639 | 9/2003 |
| GB | 2145068 | 3/1985 |
| JP | S357159 | 6/1960 |
| JP | S59133056 | 7/1984 |
| JP | H07024991 | 1/1995 |
| JP | 2012526668 | 11/2012 |
| WO | 9812051 | 3/1998 |
| WO | 2006094697 | 9/2006 |

OTHER PUBLICATIONS

Search Report dated Nov. 24, 2015, Search Report in corresponding British Patent Application GB1509471.7, dated Nov. 24, 2015; 4 pages.

APPARATUS AND METHOD FOR CUTTING, PRINTING OR EMBOSSING

RELATED APPLICATION DATA

This application is a U.S. national stage of and claims priority benefit to prior filed international application no. PCT/GB2016/000102, filed May 19, 2016, and which claims priority to British national application no. 1509471.7, filed Jun. 2, 2015. The entirety of these prior filed applications is hereby incorporated by reference herein.

TECHNICAL FIELD

The invention relates to an apparatus and method for cutting, printing or embossing a continuous sheet of material.

BACKGROUND

It is known to provide an apparatus for cutting, printing or embossing consecutive parts of a continuous sheet of material. Such an apparatus has a rotatable tool cylinder with a tool plate mounted thereon for cutting, printing or embossing the consecutive parts of the continuous sheet. The apparatus has an anvil cylinder adjacent to the tool cylinder, the continuous sheet passing between the anvil cylinder and the tool cylinder. During operation of the apparatus the continuous sheet has a constant speed through the apparatus, and the tool cylinder has a fixed speed of rotation. Tool cylinders having different diameters may be used with the apparatus. Such an apparatus may be termed a "full-rotary" apparatus.

It is also known to provide a "semi-rotary" apparatus for cutting, printing or embossing consecutive parts of a continuous sheet of material. Such an apparatus has a support which has rollers over which the continuous sheet runs, and the support is movable during operation of the apparatus to set the correct position for the consecutive parts of the continuous sheet. During operation of the apparatus the continuous sheet is required to have a variable speed through the apparatus. Furthermore the tool cylinder is required to have a constant speed of rotation during operation of the apparatus. Such an apparatus is typically used with a tool cylinder having a fixed diameter.

It is further known to provide an apparatus for cutting, printing or embossing alternate parts of a continuous sheet of material. Such an apparatus has a rotatable tool cylinder with one or two tool plates mounted thereon for cutting, printing or embossing the alternate parts of the continuous sheet. The apparatus has two anvil cylinders adjacent to the tool cylinder, the continuous sheet passing between the anvil cylinders and the tool cylinder. A support of the apparatus has two rollers over which the continuous sheet runs, and is mounted between the two anvil cylinders. The support is movable to set a phase position of the anvil cylinders and the tool cylinder so that cutting, printing or embossing occurs at the correct position of the alternate parts of the continuous sheet. The position of the support is set prior to operation of the apparatus and is in a fixed position during operation thereof. During operation of the apparatus the continuous sheet has a constant speed through the apparatus, and the tool cylinder is required to have a variable speed of rotation when not cutting, printing or embossing depending on an angle of the one or two plates mounted on the tool cylinder.

A problem associated with the known apparatus is when the tool cylinder has a variable speed of rotation. Typically the tool cylinder has a relatively large mass which means that changes in rotational speed thereof may be problematic particularly when the apparatus is operating at high production rates. In effect the requirement for a variable speed of rotation of the tool cylinder limits the speed of operation of the apparatus to cut, print or emboss the continuous sheet of material.

A problem associated with the known "full-rotary" apparatus is that it may require tool cylinders of different diameter to mount different tool plates thereon for cutting, printing or embossing. The tool cylinders of different diameter may be required when performing different tasks. The tool cylinders are expensive, and the requirement for different tool cylinders depending on the tool plate for cutting, printing or embossing increases the operational and capital cost of the apparatus. Furthermore, the requirement for multiple tool cylinders reduces the operational flexibility of the apparatus to change between different tasks because the tool cylinder must be selected and fitted prior to operation of the apparatus.

A problem with the "semi-rotary" apparatus is that the continuous sheet may be required to be stopped and reversed using the movable support to ensure that the consecutive parts are in the required position on the continuous sheet. Such stopping or reversing may be problematic particularly when the apparatus is operating at high production rates. In effect the requirement to stop or reverse the continuous sheet limits the speed of operation of the apparatus to cut, print or emboss the continuous sheet of material.

It is broadly an object of the present invention to address one or more of the above mentioned disadvantages of the previously known ways of cutting, printing or embossing.

SUMMARY

What is required is an apparatus and method which may reduce or minimise at least some of the above-mentioned problems.

According to a first aspect of the invention, there is provided an apparatus for cutting, printing or embossing a continuous sheet, comprising a tool element, at least two anvils which are co-operable with the tool element, and a phase adjustment device, the tool element being configured to have a constant surface speed during operation of the apparatus, the apparatus being adapted to receive the continuous sheet at a constant speed into the apparatus, and being adapted to output the continuous sheet at a constant speed from the apparatus, wherein the phase adjustment device is operable to adjust a speed of the continuous sheet within the apparatus in order to adjust a phase of alternate parts of the continuous sheet to be cut, printed or embossed by each anvil as it co-operates with the tool element.

Such an apparatus provides an improved flexibility to cut, print or emboss with different tool lengths on the tool element, and with an improved speed of production for cutting, printing or embossing. The continuous sheet is arranged to pass between each anvil and the tool element, and the apparatus can be used to implement a continuous process for cutting, printing or embossing of the continuous sheet. The improved speed of production is provided by the constant surface speed of the tool element, which is not required to change speed during operation of the apparatus. The improved flexibility is provided by the phase adjustment device which operates to change the phase of one cut, print or embossing relative to another alternate cut, print or embossing. Furthermore a single size tool element can be used with the apparatus due the phase adjustment device which further improves the flexibility when using the apparatus. It will be understood that the continuous sheet is a sheet of material that extends along a certain run within the apparatus, and may be fed into the apparatus from a feed roll. Overall the apparatus may reduce the time, effort, and cost involved from changing from one cutting, printing or embossing task to another. It will be understood that the adjustment of the speed of the continuous sheet within the apparatus using the phase adjustment device may include accelerating or decelerate the speed, and also reversing the direction of travel of the continuous sheet as required.

Preferably the tool element is a tool cylinder. Preferably each anvil is an anvil cylinder. Such cylinders provide a ready way to achieve the constant surface speed.

Preferably the phase adjustment device comprises at least two carriages, each carriage being associated with a respective anvil, each carriage being movable with a drive device during operation of the apparatus to provide said adjustment of the speed of the continuous sheet. Each movable carriage is adjustable during operation of the apparatus to provide the required speed of the continuous sheet and the required phase of the alternate parts of the continuous sheet.

In one embodiment an intermediate roller arrangement may be provided between adjacent carriages. Preferably the intermediate roller arrangement comprises a movable roller for adjusting a length of the continuous sheet between adjacent carriages. Such an arrangement may provide the advantage of isolating parts of the continuous sheet so that they can be tensioned differently as required.

Preferably each carriage is linearly movable between a first and second position. Preferably each carriage is horizontally linearly movable. Preferably the at least two carriages are linearly movable along a common axis. Such arrangements for the carriages provides a convenient way to change the speed and phase of the continuous sheet.

In one embodiment one carriage has an increased travel compared to another carriage. Such an arrangement may be used to provide additional operational flexibility of the apparatus.

Preferably each carriage has two rollers such that a respective portion of the continuous sheet is adapted to be between the two rollers of each carriage, each respective portion being adapted to pass between the tool element and the anvil associated with each carriage, each carriage being movable to provide said adjustment of the continuous sheet by adjusting a speed of each respective portion. Such an arrangement for partitioning the continuous sheet into portions provides an improved way to change the speed and phase of the continuous sheet.

Preferably at least one sensor device is provided for monitoring the continuous sheet within the apparatus. Preferably the continuous sheet is provided with a plurality of markers thereon, and the at least one sensor device is operable to detect the markers.

Preferably the at least one sensor device is coupled to a control device for controlling the operation of the phase adjustment device. Such sensors provide the advantage of a feedback mechanism to maintain the alternate cut, print or embossing positions in the required location on the continuous sheet.

Preferably each anvil co-operates with the tool cylinder at a respective position on the circumference thereof, the respective positions being separated by an arc of the circumference of the tool cylinder having an angle of between 60° to 120°. Preferably the arc has an angle of 90°.

In one embodiment the apparatus may be adapted to receive a continuous laminate strip between each anvil and the tool element, the continuous laminate strip having a laminate mounted thereon, each anvil being co-operable with the tool element to apply the laminate to alternate parts of the continuous sheet. Such an arrangement may be used to provide an additional printing technique.

Preferably a roller is provided between adjacent anvils, the continuous laminate strip arranged to pass around the roller. Preferably the roller is movable during operation of the apparatus. Preferably the roller is a drive roller. Such arrangements may be used to adjust a length of the continuous laminate strip between the anvils.

Preferably the tool element is heated during application of the laminate onto the continuous sheet.

Preferably the tool element is for mounting a tool plate thereon for cutting, printing or embossing the continuous sheet.

The apparatus may further include more than two anvils, each anvil for cutting, printing or embossing a consecutive parts of the continuous sheet. Such an arrangement permits more than two parts of the continuous sheet to be cut, printed or embossed per cycle of the tool element, which may be used to increase the production speed.

In one embodiment at least one of the anvils is retractable from the tool element so that it cannot cut, print or emboss the continuous sheet. Such an arrangement may be used to provide an alternative mode of operation of the apparatus, and may increase the operational flexibility of the apparatus.

According to a second aspect of the invention there is provided a method of operating an apparatus for cutting, printing or embossing a continuous sheet according to the first aspect of the invention.

According to a third aspect of the invention there is provided a method of cutting, printing or embossing a continuous sheet using an apparatus comprising a tool element, at least two anvils which are co-operable with the tool element, and a phase adjustment device, the continuous sheet having a constant speed into and out of the apparatus, the method including:

operating the tool element with a constant surface speed;

using the phase adjustment device to adjust a speed of the continuous sheet within the apparatus in order to adjust a phase of alternate parts of the continuous sheet; and cutting, printing or embossing the alternate parts of the continuous sheet using alternate anvils co-operating with the tool element.

Such a method provides an improved flexibility to cut, print or emboss with different tool lengths on the tool element, and with an improved speed of production for cutting, printing or embossing. The method can be used to implement a continuous process for cutting, printing or embossing of the continuous sheet. The improved speed of production is provided by the constant surface speed of the tool element, which is not required to change speed. The improved flexibility is provided by the phase adjustment device which operates to change the phase of one cut, print or embossing relative to another alternate cut, print or embossing. Furthermore a single size tool element can be used due the phase adjustment device which further improves the flexibility when using the method. Overall the method may reduce the time, effort, and cost involved from changing from one cutting, printing or embossing task to another.

Preferably the method further includes using a tool cylinder for the tool element. Preferably the method further includes using an anvil cylinder for each anvil. Such cylinders provide a ready way to achieve the constant surface speed.

Preferably the phase adjustment device comprises at least two carriages, each carriage being associated with a respective anvil, the method including moving each carriage to provide said adjustment of the speed of the continuous sheet. Each movable carriage is adjustable to provide the required speed of the continuous sheet and the required phase of the alternate parts of the continuous sheet.

In one embodiment the method may further include isolating the continuous sheet between each carriage using an intermediate roller arrangement. Preferably the method further includes adjusting a length of the continuous sheet between adjacent carriages using the intermediate drive roller arrangement. Such an arrangement may provide the advantage of isolating parts of the continuous sheet so that they can be tensioned differently as required.

Preferably the method further includes linearly moving each carriage between a first and a second position. Preferably the method further includes horizontally moving each carriage. Preferably the method further include linearly moving each carriage along a common axis. Such arrangements for the carriages provides a convenient way to change the speed and phase of the continuous sheet.

The method may further include moving one carriage over an increased length of travel compared to another carriage. Such an arrangement may be used to provide additional operational flexibility when using the method.

Preferably each carriage has two rollers such that a respective portion of the continuous sheet is between the two rollers of each carriage, the method further including passing each respective portion between the tool element and the anvil associated with each carriage, and moving each carriage to adjust said speed of the continuous sheet by adjusting a speed of each respective portion. Such an arrangement for partitioning the continuous sheet into portions provides an improved way to change the speed and phase of the continuous sheet.

Preferably the method further includes monitoring the continuous sheet within the apparatus using at least one sensor device. Preferably the continuous sheet has a plurality of markers thereon, the method including using the at least one sensor device to detect the markers. Preferably the at least one sensor device is coupled to a control device, the method including using the control device to control the operation of the phase adjustment device. Such sensors provide the advantage of a feedback mechanism to maintain the alternate cut, print or embossing positions in the required location on the continuous sheet.

In one embodiment a continuous laminate strip passes between each anvil and the tool element, the continuous laminate strip having a laminate mounted thereon, the method including applying the laminate to alternate parts of the continuous sheet. Such an arrangement may be used to provide an additional printing technique.

Preferably a roller is provided between adjacent anvils, the method further including passing the continuous laminate strip around the roller. Preferably the method further includes moving the roller to adjust the length of the continuous laminate strip between the anvils. Such arrangements may be used to adjust a length of the continuous laminate strip between the anvils.

Preferably the method further includes heating the tool element when applying the laminate onto the continuous sheet.

The method may further include more than two anvils, each anvil for cutting, printing or embossing a consecutive part of the continuous sheet. Such an arrangement permits more than two parts of the continuous sheet to be cut, printed or embossed per cycle of the tool element, which may be used to increase the production speed.

In one embodiment the method further includes retracting at least one of the anvils from the tool element so that it cannot cut, print or emboss the continuous sheet. Such an arrangement may be used to provide an alternative mode of operation, and may increase the operational flexibility of the method.

According to an alternative characterisation of the invention there is provided an apparatus for cutting, printing or embossing a continuous sheet, comprising a tool element, at least two anvils which are co-operable with the tool element, and at least two carriages, each carriage being associated with a respective anvil, the tool element configured to have a constant surface speed during operation of the apparatus, wherein each carriage is movable during operation of the apparatus to adjust a speed of the continuous sheet at a location where the respective anvil co-operates with the tool element during operation of the apparatus, each anvil being co-operable with the tool element to cut, print or emboss alternate parts of the continuous sheet.

According to another alternative characterisation of the invention there is provided an apparatus for cutting, printing or embossing a continuous sheet, comprising a tool element, at least two anvils which are co-operable with the tool element, and at least two carriages, each carriage being associated with a respective anvil, each carriage configured to have a respective portion of the continuous sheet which is arranged to pass between the tool element and its associated anvil, the tool element configured to have a constant surface speed during operation of the apparatus, wherein each carriage is movable during operation of the apparatus to adjust a speed of its respective portion of the continuous sheet during operation of the apparatus, each anvil being co-operable with the tool element to cut, print or emboss alternate parts of the continuous sheet.

According to another alternative characterisation of the invention there is provided an apparatus for cutting, printing or embossing a continuous sheet, comprising a tool element, at least two anvils which are co-operable with the tool element, and at least two carriages, each carriage being associated with a respective anvil, each carriage configured to have a respective portion of the continuous sheet which passes between the tool element and one anvil, the tool element configured to have a constant surface speed during operation of the apparatus, wherein each carriage is movable during operation of the apparatus to adjust a speed of its respective portion of the continuous sheet during operation of the apparatus, one anvil being co-operable with the tool element to cut, print or emboss a first part of the continuous sheet, and another anvil being co-operable with the tool element to cut, print or emboss a second part of the continuous sheet which is adjacent to the first part.

According to another alternative characterisation of the invention there is provided a method of cutting, printing or embossing a continuous sheet using an apparatus comprising a tool element, at least two anvils which are co-operable with the tool element, and at least two carriages, each carriage being associated with a respective anvil, the continuous sheet having a constant speed into and out of the apparatus, the method including:

operating the tool element with a constant surface speed;

moving each carriage during operation of the apparatus to adjust a speed of the continuous sheet within the apparatus at a location where the respective anvil co-operates with the tool element during operation of the apparatus; and cutting, printing or embossing the alternate parts of the continuous sheet using alternate anvils co-operating with the tool element.

According to another alternative characterisation of the invention there is provided a method of cutting, printing or embossing a continuous sheet using an apparatus comprising a tool element, at least two anvils which are co-operable with the tool element, and at least two carriages, each carriage being associated with a respective anvil, the continuous sheet having a constant speed into and out of the apparatus, the method including:

operating the tool element with a constant surface speed;

providing a respective portion of the continuous sheet associated with each carriage which is arranged to pass between the tool element and its associated anvil;

moving each carriage during operation of the apparatus to adjust a speed of its respective portion of the continuous sheet within the apparatus; and cutting, printing or embossing alternate parts of the continuous sheet using alternate anvils co-operating with the tool element.

According to another alternative characterisation of the invention there is provided a method of cutting, printing or embossing a continuous sheet using an apparatus comprising a tool element, at least two anvils which are co-operable with the tool element, and at least two carriages, each carriage being associated with a respective anvil, the continuous sheet having a constant speed into and out of the apparatus, the method including:

operating the tool element with a constant surface speed;

providing a respective portion of the continuous sheet associated with each carriage which is arranged to pass between the tool element and its associated anvil;

moving each carriage during operation of the apparatus to adjust a speed of its respective portion of the continuous sheet within the apparatus;

cutting, printing or embossing a first part of the continuous sheet using one anvil co-operating with the tool element; and cutting, printing or embossing a second part of the continuous sheet using another anvil co-operating with the tool element, which is adjacent to the first part.

Any preferred or optional features of one aspect or characterisation of the invention may be a preferred or optional feature of other aspects or characterisations of the invention.

BRIEF DESCRIPTION OF THE DRAWINGS

Other features of the invention will be apparent from the following description of preferred embodiments shown by way of example only with reference to the accompanying drawings, in which.

DETAILED DESCRIPTION

Figure 1:
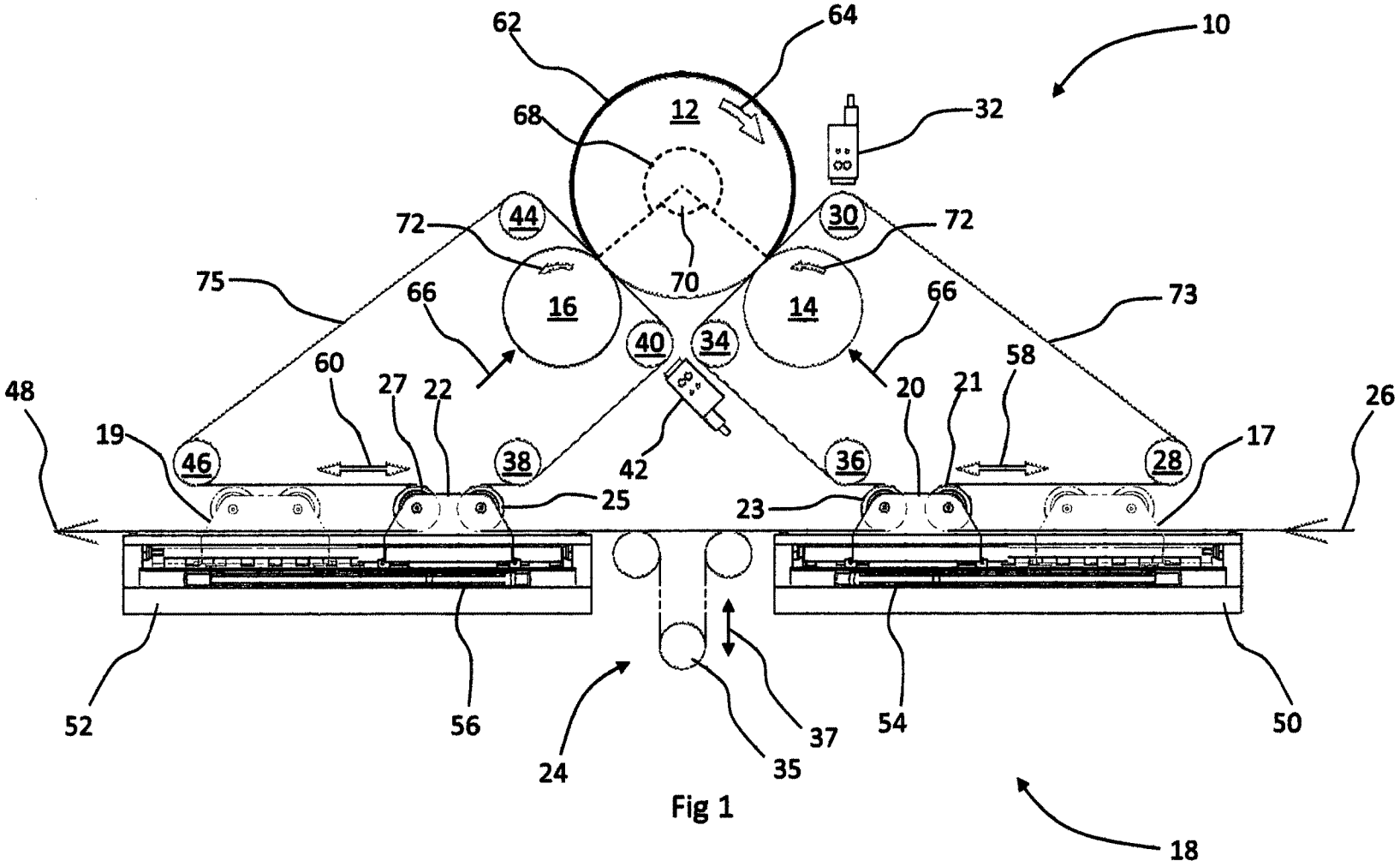
FIG. 1 shows a schematic side view of an apparatus according to an embodiment of the invention.

FIG. 1 shows a schematic side view of an apparatus according to an embodiment of the invention, generally designated 10. The apparatus 10 has a tool cylinder 12 with first and second anvil cylinders 14, 16 co-operable therewith. The anvil cylinders 14, 16 may be alternatively termed impression cylinders or anvils. The apparatus 10 also has a phase adjustment device 18 comprising a first carriage 20 and a second carriage 22, which are linearly movable. The carriages 20, 22 may alternatively be termed shuttles. The first carriage 20 is shown in a left position, and the second carriage 22 is shown in a right position. Also shown in feint outline are a right position 17 of the first carriage 20 and a left position 19 of the second carriage 22. The first carriage 20 has respective right and left rollers 21, 23. The second carriage 22 has respective right and left rollers 25, 27. An intermediate drive roller arrangement 24 is also shown between the two carriages 20, 22. The intermediate drive roller arrangement 24 is an optional arrangement and may not be required. The intermediate drive roller arrangement 24 may alternatively be termed an intermediate roller arrangement and may be an intermediate idler roller arrangement.

A continuous sheet 26 is shown to be fed into a right hand side of the apparatus 10. The continuous sheet 26 is of a material to be cut, printed or embossed, and may alternatively be termed a continuous material sheet. For example, the continuous sheet 26 may comprise printed labels or stickers repeated along the length of the continuous sheet 26. The continuous sheet 26 is fed into the apparatus 10 at a constant speed from a feed roll (not shown), and it will be understood that the apparatus 10 shown may be part of a larger apparatus for cutting, printing or embossing of the continuous sheet 26. The continuous sheet 26 then passes around the right roller 21 of the first carriage 20, then around first and second rollers 28, 30 before passing between the tool cylinder 12 and the first anvil cylinder 14. A sensing device 32 adjacent to the second roller 30 is operable to monitor the position of a printed image on the continuous sheet 26 as it moves through the apparatus 10. The continuous sheet 26 then passes around third and fourth rollers 34, 36 and then passes around the left roller 23 of the first carriage 20. The continuous sheet 26 may then pass around the intermediate drive roller arrangement 24 if required before passing around the right roller 25 of the second carriage 22. The continuous sheet 26 then passes around fifth and sixth rollers 38, 40 before passing between the tool cylinder 12 and the second anvil cylinder 16. A sensing device 42 adjacent to the sixth roller 40 is operable to monitor the position of the printed image on the continuous sheet 26 as it moves through the apparatus 10. The continuous sheet 26 then passes around seventh and eighth rollers 44, 46 and then passes around the left roller 27 of the second carriage 22. The continuous sheet 26 then exits the apparatus 10 at a constant speed as shown at 48.

The first and second carriages 20, 22 are horizontally linearly movable with a reciprocating movement on a respective support 50, 52. The first and second carriages 20, 22 are linearly movable on a common axis. Respective drive devices 54, 56 of the supports 50, 52 operate each of the first and second carriages 20, 22 so that they are linearly movable. During operation of the apparatus 10 the carriages 20, 22 may move back and forth with a relatively high speed, and are required to be relatively light weight. For example, the rollers 21, 23, 25, 27 of each carriage 20, 22 are of carbon fibre reinforced plastic to provide the required strength and low mass. The drive devices 54, 56 may be hydraulic actuators or electric linear servo motors. The two carriages 20, 22 can be considered as being adjacent to one another on the length of the continuous sheet 26.

The tool cylinder 12 may alternatively be termed a tool element or a die cylinder for cutting, printing or embossing the continuous sheet 26. The tool cylinder 12 is magnetic and has a flexible plate 62 magnetically attached to a surface of the tool cylinder 12 according to known arrangements. The plate 62 is of metal and has a die to cut or emboss the continuous sheet 26, or an image to be printed on the continuous sheet 26. The plate 62 may alternatively be termed a tool plate. During operation of the apparatus 10 the tool cylinder 12 is driven so that it rotates in a clockwise direction at a constant speed, as shown by arrow 64, so that it has a constant surface speed. According to the embodiment of the invention the flexible plate 62 covers an arc of the circumference of the tool cylinder 12, which is defined by an angle 68 of the tool cylinder 12, and which is for example a maximum of 270°. An arc of the circumference of the tool cylinder 12, which is not covered by the flexible plate 62 is defined by an angle 70, which is for example a maximum of 90°. The angle 68 may alternatively be termed a repeat angle.

During operation of the apparatus 10 the two anvil cylinders 14, 16 are urged towards the tool cylinder 12 as required to cut, print or emboss alternate parts of the continuous sheet 26, as shown by arrows 66. Such movement of the anvil cylinders 14, 16 may be provided by respective hydraulic or pneumatic actuators (not shown). Each anvil cylinder 14, 16 cooperates with the tool cylinder 12 at a respective position on the circumference of the tool cylinder 12 whereby the respective positions are separated by an arc of the circumference of the tool cylinder 12, and where the arc has an angle of 90°. During operation of the apparatus 10 the two anvil cylinders 14, 16 are driven so that they rotate in an anti-clockwise direction at a constant speed, as shown by arrows 72. The speed of the circumferential surface of the two anvil cylinders 14, 16 and the circumferential surface of the tool cylinder 12 is matched.

During cutting, printing or embossing of the continuous sheet 26 the phase adjustment device 18 is used to synchronise the speed of the continuous sheet 26 with the speed of the surface of the cylinders 12, 14, 16. The continuous sheet 26 is maintained at the speed of the surface of the cylinders 12, 14, 16 when cutting, printing or embossing. In other words the continuous sheet 26 is maintained at the speed of the surface of the cylinders 12, 14 when cutting, printing or embossing is being performed by the tool cylinder 12 and the first anvil cylinder 14, and is again maintained at the speed of the surface of the cylinders 12, 16 when cutting, printing or embossing is being performed by the tool cylinder 12 and the second anvil cylinder 16. When the apparatus 10 is not cutting, printing or embossing the continuous sheet 26 the phase adjustment device 18 is used to change the speed of the continuous sheet 26 within the apparatus 10 relative to the speed of the surface of the cylinders 12, 14, 16. Such an arrangement is used to provide accurate cutting, printing or embossing of the continuous sheet 26 at alternate locations of the continuous sheet 26.

The intermediate drive roller arrangement 24 may be used to achieve the required length of the continuous sheet 26 between the point of contact between the tool cylinder 12 and each of the anvil cylinders 14, 16. The intermediate drive roller arrangement 24 may comprise a movable roller 35 that is vertically movable as shown at 37, but it will be appreciated that the movable roller 35 may be movable in any direction, such as horizontally moveable. Such an arrangement may assist with achieving the required cutting, printing or embossing position on the continuous sheet 26. The intermediate drive roller arrangement 24 may assist with driving the continuous sheet 26 through the apparatus 10, and may also provide an isolating effect for different parts of the continuous sheet 26 so that they can be tensioned differently. An alternative or in addition to the intermediate drive roller arrangement 24 may be that the second carriage 22 has an increased length of travel when compared to the first carriage 21.

The sensing devices 32, 42 are used to monitor the moving continuous sheet 26 and position of the cut, print or embossing on the continuous sheet 26. This may be achieved by having periodic registration markers on the continuous sheet 26 and using the sensing devices 32, 42 to detect the markers, which may be a series of black lines or other markers on the continuous sheet 26. The sensing devices 32, 42 may be cameras. The sensing devices 32, 42 are coupled to a control device (not shown) which has a processor to communicate with the drive devices 54, 56 to adjust the movement of the carriages 20, 22 as required, and with the actuators operating the anvil cylinders 14, 16 as required. The actuators for the anvil cylinders 14, 16 urge them against the tool cylinder 12, and each anvil cylinder 14, 16 remains in place whilst the apparatus 10 is operating. A gap is created between the tool cylinder 12 and each anvil cylinder 14, 16 due to the lack of the plate 62 on the cylinder, and is sufficient to allow the continuous sheet 26 to move freely between each anvil cylinder 14, 16 and the tool cylinder 12. The sensing devices 32, 42 provide a feedback mechanism to maintain the cut, print or embossing position in the required location on the continuous sheet 26. In the situation where the continuous sheet 26 is blank the registration marker would not be required.

One or more of the rollers 21, 28, 30, 34, 35, 36, 23, 25, 38, 40, 44, 46 and 27 may be a driven roller or an idler roller to assist with passage of the continuous sheet 26 through the apparatus 10, and to provide the required feeding of the continuous sheet 26 through the apparatus 10.

It will be appreciated that the first carriage 20 is operable to change a speed of a first portion 73 of the continuous sheet 26, the first portion 73 being between rollers 21, 23 of the first carriage 20. Furthermore, the second carriage 22 is operable to change a speed of a second portion 75 of the continuous sheet 26, the second portion 75 being between rollers 25, 27 of the second carriage 22. Each first and second portions 73, 75 of the continuous sheet 26 may substantially form the shape of a four-sided shape, such as a rhomboid having non-equal sides, when viewed from the side as shown in FIG. 1. In other words, each of the first and second portions 73, 75 have a shape which has four sides whereby each carriage 20, 22 is linearly movable along one side the first and second portions 73, 75.

Figure 2:
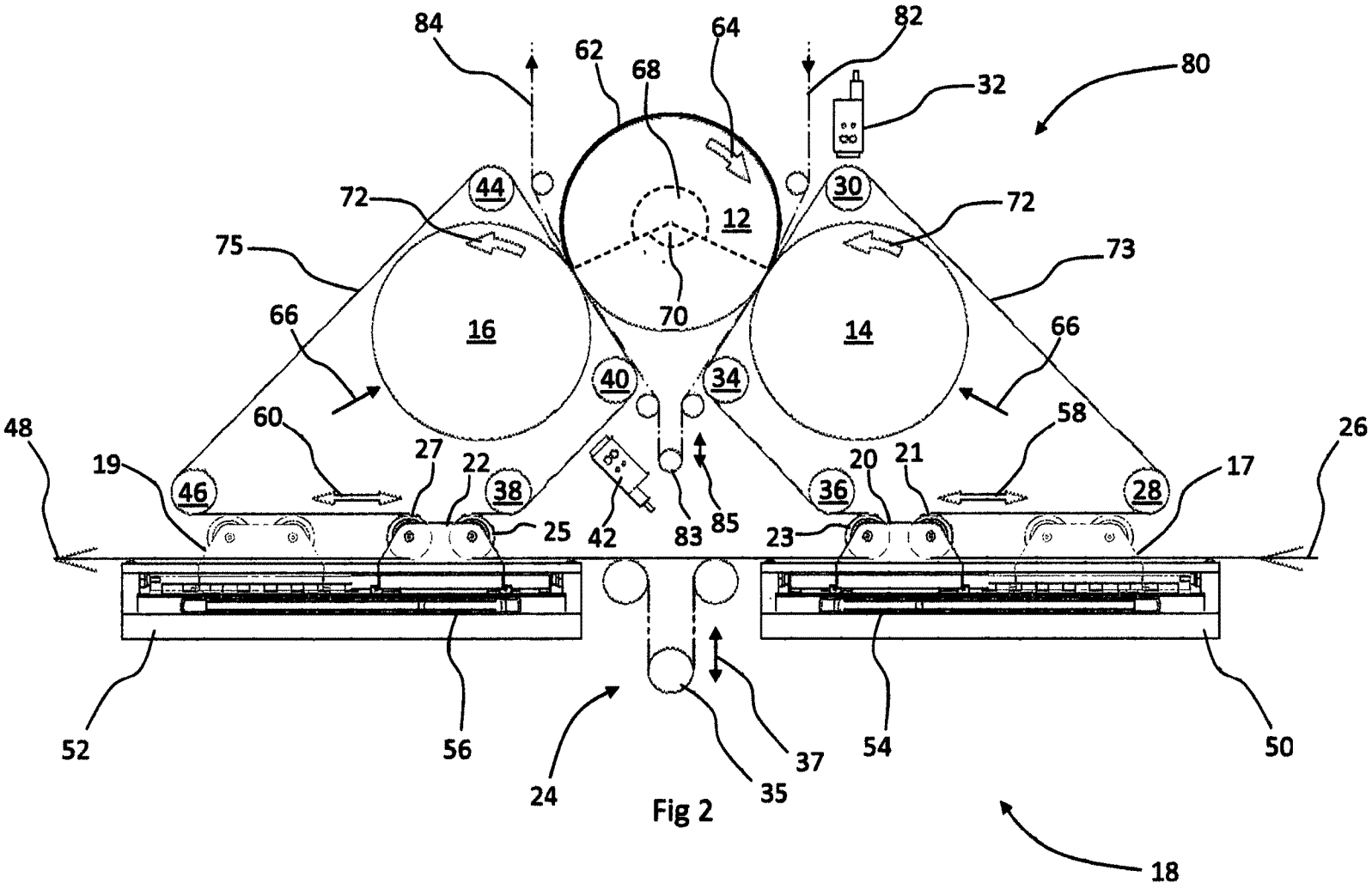
FIG. 2 shows a schematic side view of an apparatus according to another embodiment of the invention.

FIG. 2 shows a schematic side view of an apparatus according to another embodiment of the invention, generally designated 80. In FIG. 2 like features to the arrangements of FIG. 1 are shown with like reference numerals. In FIG. 2 the apparatus 80 is for applying a foil or a laminate mounted on a laminate sheet 82 to the continuous sheet 26. The laminate sheet 82 may alternatively be termed a continuous laminate sheet or a continuous laminate strip. The technique of applying the laminate or foil to the continuous sheet 26 may be termed a "hot foil" technique, and is a way of printing or applying the laminate or foil to the continuous sheet 26. Typically such a hot foil technique is used to provide a metallic foil finish to portions of labels of the continuous sheet 26. The laminate sheet 82 comprises a clear plastic web with the foil or laminate mounted thereon.

The tool cylinder 12 of the apparatus 80 is heated so that a surface thereof has a temperature in the region of 200° C.

Heating of the tool cylinder 12 may be achieved using hot oil passing through the tool cylinder 12 according to known arrangements. The first and second anvil cylinders 14, 16 have rubber surfaces and are co-operable with the tool cylinder 12 therewith. According to the embodiment the tool cylinder 12 rotates at a constant speed during operation of the apparatus 80. The speed of the circumferential surface of the two anvil cylinders 14, 16 and the tool cylinder 12 is matched. The laminate or foil is transferred to the continuous sheet 26 by the application of heat and pressure.

The continuous sheet 26 is fed into the apparatus 80 at a constant speed in the same manner as the embodiment of FIG. 1, and passes around rollers 21, 28, 30, 34, 35, 36, 23, 25, 38, 40, 44, 46 and 27. Similarly during printing of the continuous sheet 26 the phase adjustment device 18 is used to synchronise the speed of the continuous sheet 26 with the speed of the surface of the cylinders 12, 14, and the cylinders 12, 16. In FIG. 2 the laminate sheet 82 enters the apparatus 80 and passes between the tool cylinder 12 and the anvil cylinder 14 so that it is sandwiched between the continuous sheet 26 and the tool cylinder 12. The laminate sheet 82 then passes around a roller 83 and then passes between the tool cylinder 12 and the anvil cylinder 16 so that it is sandwiched between the continuous sheet 26 and the tool cylinder 12. The laminate sheet 82 then exits the apparatus 80 as shown at 84. The speed of the laminate sheet 82 is synchronised with the tool cylinder 12 and the anvil cylinders 14, 16 during printing of the continuous sheet 26. As the flexible plate 62 contacts the laminate sheet 82 when interacting with each of the anvil cylinders 14, 16 the foil or laminate is transferred to the continuous sheet 26, which creates used or stamped portions of the laminate sheet 82. It will be appreciated that a first part of the laminate sheet 82 is used or stamped by the first anvil cylinder 14, and a second part of the laminate sheet 82 is used or stamped by the second anvil cylinder 16. The first and second part of the laminate sheet 82 are next to each other. The roller 83 may be vertically adjustable as shown at 85 before operation of the apparatus 80 to adjust the length of the laminate sheet 82 between the two anvil cylinders 14, 16. The roller 83 is operable to provide such an alternate use of portions of the laminate sheet 82, and it will be understood that the laminate sheet 82 changes speed during operation of the apparatus 80 to provide such alternate printing. The required changes in speed of the laminate sheet 82 during operation of the apparatus 80 are provided by a supply and return device (not shown) to ensure that the laminate sheet 82 enters and exits the apparatus 80 at the required speed. In another arrangement the roller 83 is a driven roller.

Figure 3:
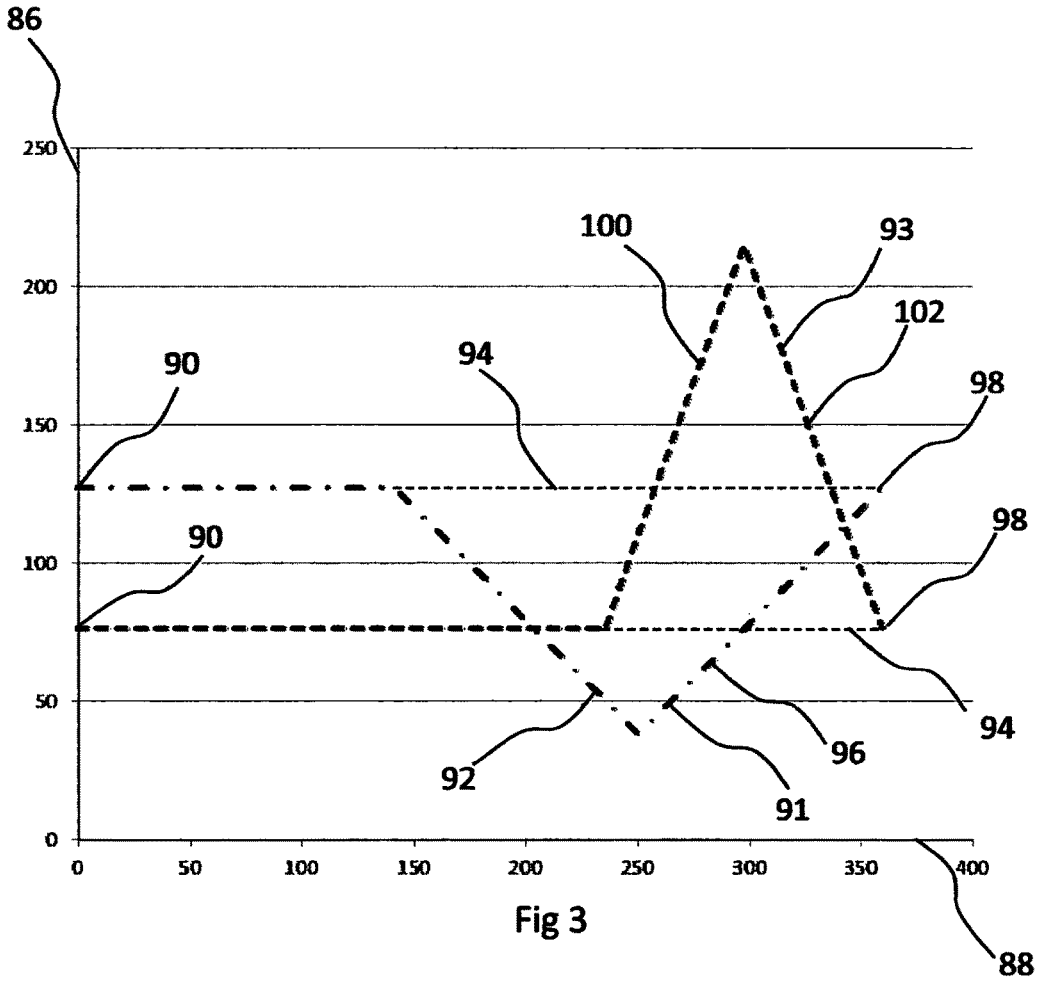
FIG. 3 shows timing graphs for the continuous sheet shown in FIGS. 1 and 2.

FIG. 3 shows timing graphs for the continuous sheet 26 shown in FIGS. 1 and 2. The axes in FIG. 3 show a speed of the continuous sheet 26 on the y-axis 86 in meters per minute (m/min), and an angle of rotation of the tool cylinder 12 on the x-axis 88 during one revolution, i.e. one cycle, of the tool cylinder 12. Graphs 91, 93 show an example of the speed of the continuous sheet 26 at a point between either of the anvil cylinders 14, 16 and the tool cylinder 12 for when the flexible plate 62 is 300 mm and 500 mm respectively. The lengths 300 mm and 500 mm of the flexible plate 62 may be termed a repeat length. In effect the graphs 91, 93 show the speed profile of the continuous sheet 26 when it is within the apparatus 10, 80.

The graph 91 shows the speed of the continuous sheet 26 at the point between one anvil cylinder 14, 16 and the tool cylinder 12 when the angle 68 of the flexible plate 62 is less than 180°, i.e. when the flexible plate covers less than half of the circumference of the tool cylinder 12. When the tool cylinder 12 is at 0° the cutting, printing or embossing starts and the continuous sheet 26 is at a constant speed, as shown at 90. The apparatus 10, 80 in FIGS. 1 and 2 shows the tool cylinder 12 at 0° just prior to cutting, printing or embossing at the first anvil cylinder 14. After cutting, printing or embossing of the continuous sheet 26 it is decelerated by linear movement of one of the carriages 20, 22, as shown at 92 in FIG. 3. The surface of the tool cylinder 12 is shown to be constant throughout the cycle as shown at 94. Decelerating the continuous sheet 26 permits the flexible plate 62 to catch up with the continuous sheet 26 so that cutting, printing or embossing can occur at the correct part of the continuous sheet 26. When the flexible plate 62 has caught up with the continuous sheet 26 it is accelerated by linear movement of one of the carriages 20, 22, as shown at 96, so that cutting, printing or embossing can begin again when the continuous sheet 26 has reached the same speed as the surface of the tool cylinder 12, as shown at 98.

The graph 93 shows the speed of the continuous sheet 26 at the point between one anvil cylinder 14, 16 and the tool cylinder 12 when the angle 68 of the flexible plate 62 is greater than 180°, i.e. when the flexible plate covers more than half of the circumference of the tool cylinder 12. On the graphs 91, 93 like features are shown with like reference numerals. On the graph 93 when the tool cylinder 12 is at 0° the cutting, printing or embossing starts and the continuous sheet 26 is at a constant speed, as shown at 90. After cutting, printing or embossing of the continuous sheet 26 it is accelerated by linear movement of one of the carriages 20, 22, as shown at 100. The surface of the tool cylinder 12 is shown to be constant throughout the cycle as shown at 94. Accelerating the continuous sheet 26 permits it to catch up with the flexible plate 62 so that cutting, printing or embossing can occur at the correct part of the continuous sheet 26. When the continuous sheet 26 has caught up with the flexible plate 62 the continuous sheet 26 is decelerated by linear movement of one of the carriages 20, 22, as shown at 102, so that cutting, printing or embossing can begin again when the continuous sheet 26 has reached the same speed as the surface of the tool cylinder 12, as shown at 98.

It will be appreciated that when the angle 68 of the flexible plate 62 is 180°, i.e. when the flexible plate covers half of the circumference of the tool cylinder 12, the speed of the continuous sheet 26 through the apparatus 10, 80 is constant throughout the cycle of the tool cylinder 12. The requirement for the continuous sheet 26 to be accelerated or decelerated is so that the cutting, printing or embossing can occur at alternate positions on the continuous sheet 26 using one anvil cylinder 14 and then the other anvil cylinder 16. Cutting, printing or embossing at alternate positions of the continuous sheet 26 means that for each single rotation of the tool cylinder 12 there are two cuts, prints or embosses of the continuous sheet 26. Such an arrangement improves the speed at which the continuous sheet 26 can be cut, printed or embossed.

In FIG. 3 the continuous sheet 26 is shown so that it does not go below zero, i.e. it does not travel backwards. In some situations the continuous sheet 26 may travel backwards, which may depend on parameters such as the repeat length of the flexible plate 62, an acceleration rate of the continuous sheet 26, a deceleration rate of the continuous sheet 26, and a maximum or minimum speed of the continuous sheet 26 among other parameters.

Figure 4:
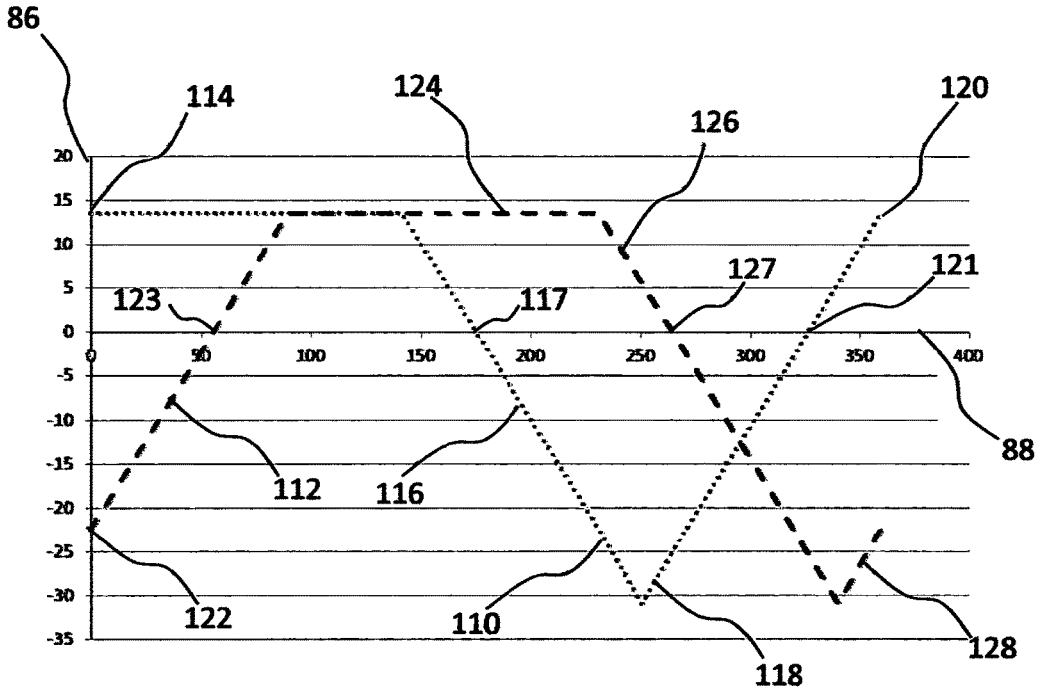
FIGS. 4 and 5 show timing graphs for the carriages shown in FIGS. 1 and 2.
Figure 5:
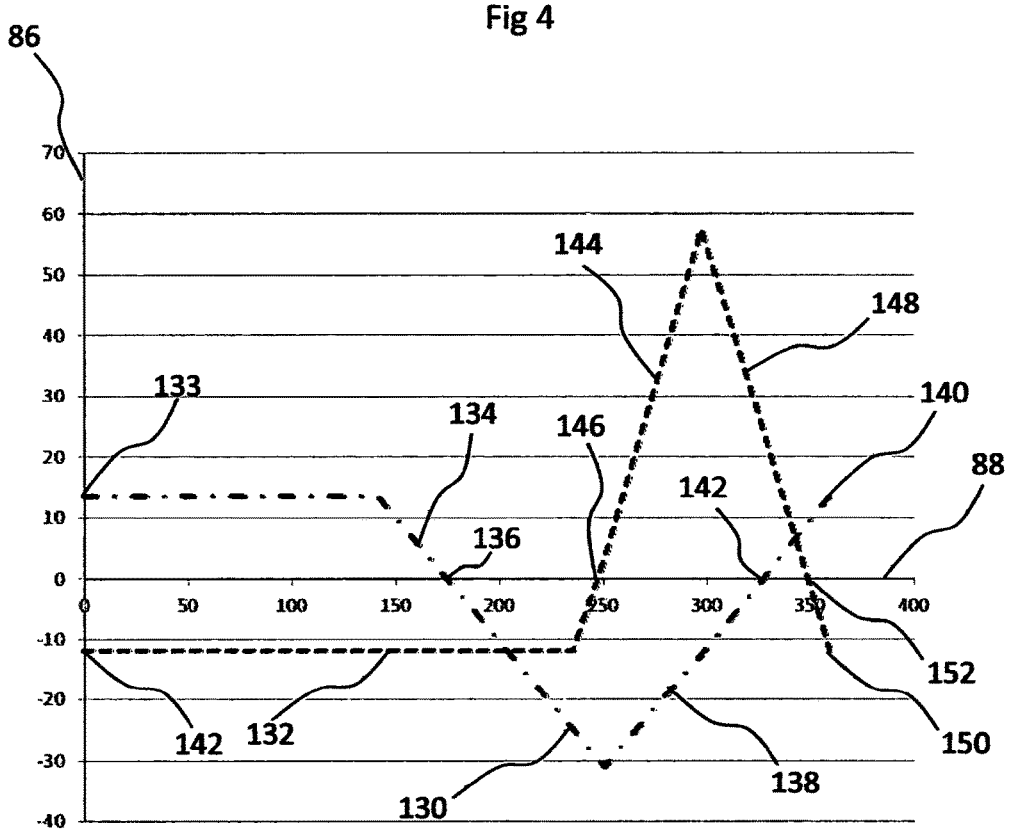

FIGS. 4 and 5 show timing graphs for the carriages 20, 22 shown in FIGS. 1 and 2. In FIGS. 4 and 5 like features are shown with like reference numerals. In FIGS. 4 and 5 the y-axis 86 shows the speed of the carriages 20, 22 in meters per minute (m/min), and the x-axis 88 shows an angle of rotation of the tool cylinder 12 during one revolution, i.e. one cycle, of the tool cylinder.

FIG. 4 shows the motion of the two carriages 20, 22 for when the flexible plate 62 is 300 mm, and when the angle 70 on the tool cylinder 12 shown in FIGS. 1 and 2 is 90°. In FIG. 4 two graphs 110, 112 show the speed of the carriages 20, 21 respectively during one cycle of the tool cylinder 12. On the graph 110, when the tool cylinder 12 is at 0° the cutting, printing or embossing starts and the carriage 20 is shown at a constant speed, as shown at 114. The apparatus 10, 80 in FIGS. 1 and 2 shows the tool cylinder 12 at 0° just prior to cutting, printing or embossing at the first anvil cylinder 14. After cutting, printing or embossing of the continuous sheet 26 the carriage 20 is decelerated, as shown at 116 in FIG. 4. It will be appreciated that the carriage 20 changes direction as shown at 117. Decelerating the carriage 20 permits the flexible plate 62 to catch up with the continuous sheet 26 so that cutting, printing or embossing can occur at the correct part of the continuous sheet 26. The carriage 20 is then accelerated, as shown at 118, so that cutting, printing or embossing can begin again when the continuous sheet 26 has reached the same speed as the surface of the tool cylinder 12, as shown at 120. The carriage 20 changes direction at 121.

The graph 112 for the carriage 22 is 90° out of phase with the graph 110 during rotation of the tool cylinder 12. On the graph 112, the carriage 22 is shown to be accelerating at 122. It will be appreciated that the carriage 22 changes direction as shown at 123. When the tool cylinder 12 is at 90° the cutting, printing or embossing starts and the carriage 22 is shown at a constant speed, as shown at 124. After cutting, printing or embossing of the continuous sheet 26 the carriage 22 is decelerated, as shown at 126. It will be appreciated that the carriage 22 changes direction as shown at 127. Decelerating the carriage 22 permits the flexible plate 62 to catch up with the continuous sheet 26 so that cutting, printing or embossing can occur at the correct part of the continuous sheet 26. When the flexible plate 62 has caught up with the continuous sheet 26 the carriage 22 is accelerated, as shown at 128.

FIG. 5 shows the motion of one carriage 20 for when the flexible plate 62 is 300 mm and 500 mm respectively in two graphs 130, 132. On the graph 130, when the tool cylinder 12 is at 0° the cutting, printing or embossing starts and the carriage 20 is shown at a constant speed at 133. The apparatus 10, 80 in FIGS. 1 and 2 shows the tool cylinder 12 at 0° just prior to cutting, printing or embossing at the first anvil cylinder 14. After cutting, printing or embossing of the continuous sheet 26 the carriage 20 is decelerated, as shown at 134 in FIG. 4. It will be appreciated that the carriage 20 changes direction as shown at 136. Decelerating the carriage 20 permits the flexible plate 62 to catch up with the continuous sheet 26 so that cutting, printing or embossing can occur at the correct part of the continuous sheet 26. The carriage 20 is then accelerated, as shown at 138, so that cutting, printing or embossing can begin again when the continuous sheet 26 has reached the same speed as the surface of the tool cylinder 12, as shown at 140. The carriage 20 changes direction at 142.

On the graph 132, when the tool cylinder 12 is at 0° the cutting, printing or embossing starts and the carriage 20 is shown at a constant speed at 142. After cutting, printing or embossing of the continuous sheet 26 the carriage 20 is accelerated, as shown at 144. It will be appreciated that the carriage 20 changes direction as shown at 146. Accelerating the carriage 20 permits the continuous sheet 26 to catch up with the flexible plate 62 so that cutting, printing or embossing can occur at the correct part of the continuous sheet 26. The carriage 20 is then decelerated, as shown at 148, so that cutting, printing or embossing can begin again when the continuous sheet 26 has reached the same speed as the surface of the tool cylinder 12, as shown at 150. The carriage 20 changes direction at 152.

During cutting, printing or embossing the tool cylinder 12 and one or both of the anvil cylinders 14, 16 interact with the continuous sheet 26. When not cutting, printing or embossing the tool cylinder 12, and anvil cylinders 14, 16 do not interact with the continuous sheet 26. During cutting, printing or embossing the speed of the continuous sheet 26 is synchronised to the tool cylinder 12 and the anvil cylinders 14, 16. The speed is synchronised over the length of the flexible plate 62, which corresponds to an image or impression length on the continuous sheet 26. As the flexible plate 62 leaves contact with the continuous sheet 26 and when the blank portion of the tool cylinder 12 is adjacent to the continuous sheet 26, one of the carriages 20, 22 is used to position the continuous sheet 26 at a portion thereof where the next cut, print or embossing is required. When positioning the continuous sheet 26 a leading edge of the portion thereof to be cut, printed or embossed corresponds to a leading edge of the flexible plate 62. The carriages 20, 22 adjust a phase of the position of the cutting, printing or embossing on the continuous sheet 26.

Figure 6:
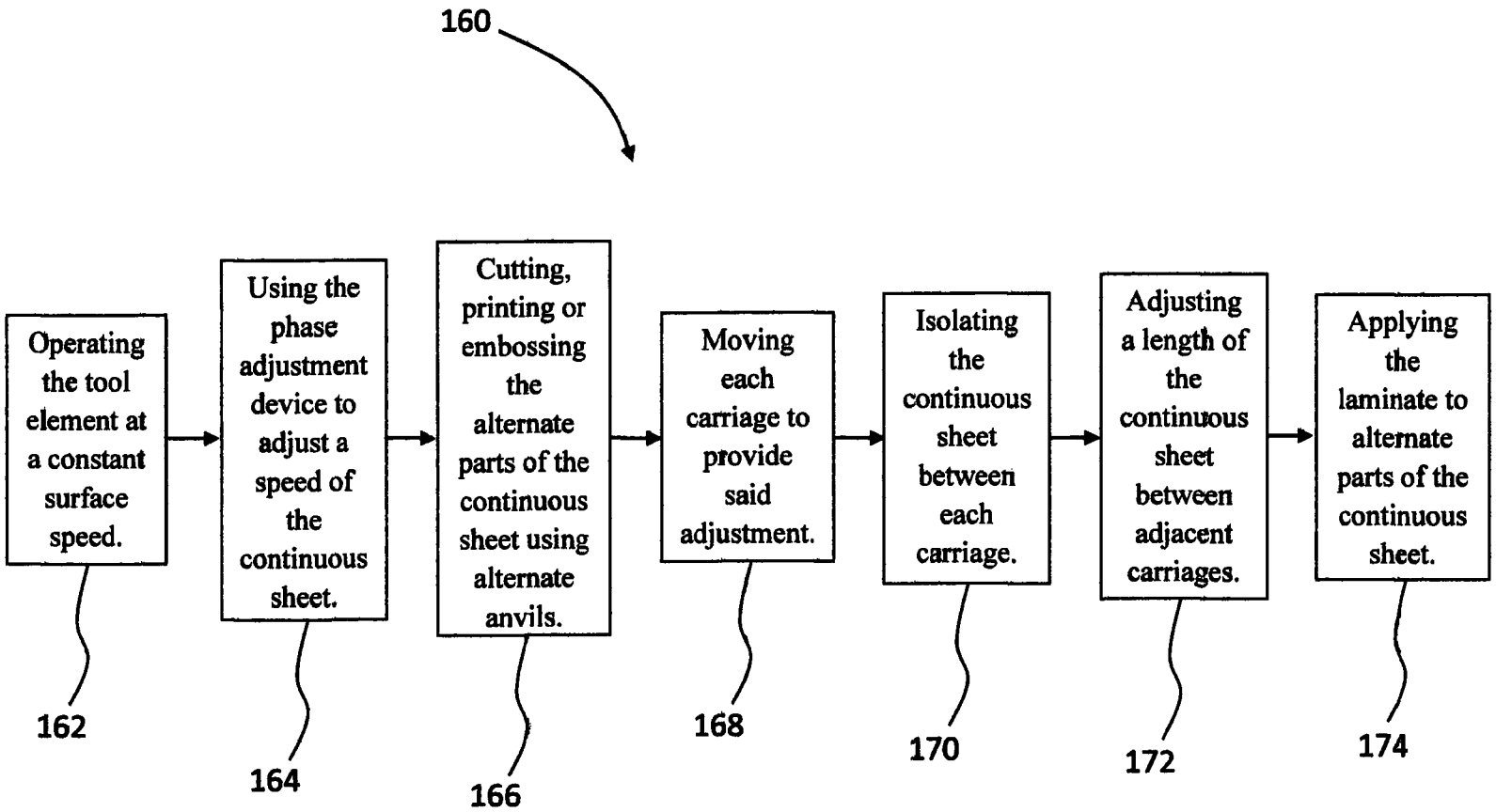
FIG. 6 shows a diagram of a method according to an embodiment of the invention.

FIG. 6 shows a diagram of a method according to an embodiment of the invention, generally designated 160. It will be appreciated that the steps may be performed in a different order, and may not necessarily be performed in the order shown in FIG. 6. The method 160 is a method of cutting, printing or embossing a continuous sheet 26 using an apparatus 10, 80 comprising a tool element 12, at least two anvils 14, 16 which are co-operable with the tool element 12, and a phase adjustment device 18, the continuous sheet 26 having a constant speed into and out of the apparatus 10, 80, the method including operating the tool element 12 with a constant surface speed, as shown at 162. The method including using the phase adjustment device 18 to adjust a speed of the continuous sheet 26 within the apparatus 10, 80 in order to adjust a phase of alternate parts of the continuous sheet 26, as shown at 164. The method including cutting, printing or embossing the alternate parts of the continuous sheet 26 using alternate anvils 14, 16 co-operating with the tool element 12, as shown at 166.

The method further includes using a tool cylinder 12 for the tool element, and using an anvil cylinder 14, 16 for each anvil. The phase adjustment device 18 comprises at least two carriages 20, 22, each carriage 20, 22 being associated with a respective anvil 14, 16, the method includes moving each carriage 20, 22 to provide said adjustment of the speed of the continuous sheet 26, as shown at 168.

The method further includes isolating the continuous sheet 26 between each carriage 20, 22 using an intermediate roller arrangement 24, as shown at 170. The method further includes adjusting a length of the continuous sheet 26 between adjacent carriages 20, 22 using the intermediate drive roller arrangement 24, as shown at 172. The method further includes linearly moving each carriage 20, 22 between a first and a second position. The method further includes horizontally moving each carriage 20, 22. The method further includes linearly moving each carriage 20, 22 along a common axis. The method further includes moving one carriage 20, 22 over an increased length of travel compared to another carriage 20, 22.

Each carriage 20, 22 has two rollers 21, 23, 25, 27 such that a respective portion 73, 75 of the continuous sheet is between the two rollers 21, 23, 25, 27 of each carriage 20, 22, the method further includes passing each respective portion 73, 75 between the tool element 12 and the anvil 14, 16 associated with each carriage 20, 22, and moving each carriage 20, 22 to adjust said speed of the continuous sheet 26 by adjusting a speed of each respective portion 73, 75, as shown at 168.

The method further includes monitoring the continuous sheet 26 within the apparatus 10, 80 using at least one sensor device 32, 42. The continuous sheet 26 has a plurality of markers thereon, the method includes using the at least one sensor device 32, 42 to detect the markers. The at least one sensor device 32, 42 is coupled to a control device, the method including using the control device to control the operation of the phase adjustment device 18.

A continuous laminate strip 82 passes between each anvil 14, 16 and the tool element 12, the continuous laminate strip 82 having a laminate mounted thereon, the method including applying the laminate to alternate parts of the continuous sheet 26, as shown at 174. The method further includes heating the tool element 12 when applying the laminate onto the continuous sheet 26.

A roller 83 is provided between adjacent anvils 14, 16, the method further including passing the continuous laminate strip 82 around the roller 83. The method further includes moving the roller 83 to adjust the length of the continuous laminate strip 82 between the anvils 14, 16.

The apparatus may include more than two anvils 14, 16, each anvil for cutting, printing or embossing a consecutive part of the continuous sheet 26. The method further including retracting at least one of the anvils 14, 16 from the tool element 12 so that it cannot cut, print or emboss the continuous sheet.

In the above embodiments the tool cylinder is described as being a drum or cylinder. It is also envisaged that the tool cylinder could be a belt having the flexible plate mounted thereon. With such an arrangement the belt may not be cylindrical in shape during operation of the apparatus, and may pass over a plurality of belt rollers, such as three of four belt rollers, during operation of the apparatus. It will be appreciated that the belt is a continuous belt, and may be termed a tool element.

In the above embodiments two anvil cylinders 14, 16 are shown. It is envisaged that in another embodiment there may be more than two anvil cylinders 14, 16, for example, three or four anvil cylinders 14, 16. With such an apparatus having more than two anvil cylinders 14, 16 the continuous sheet 26 is cut, printed or embossed at consecutive positions of the continuous sheet. In other words a first anvil cylinder 14 cuts, prints or embosses a first position of the continuous sheet 26, a second anvil cylinder 16 cuts, prints or embosses a second position of the continuous sheet 26 which is adjacent to the first position, a third anvil cylinder cuts, prints or embosses a third position of the continuous sheet 26 which is adjacent to the second position etc. With such an arrangement each anvil cylinder 14, 16 has a respective carriage 20, 22.

In the above embodiments the apparatus 10, 80 is described for cutting the continuous sheet 26, which may include partial cutting thereof. With such an arrangement the continuous sheet 26 comprises a substrate layer and a printed layer, and the partial cutting comprises cutting only the printed layer.

In one embodiment the apparatus 10, 80 may be operated using only one of the anvil cylinders 14, 16 whereby the other anvil cylinder 14, 16 is retracted so that it cannot cooperate with the tool cylinder 12. With such an arrangement the tool cylinder 12 has a constant speed of rotation during operation of the apparatus 10, 80 and one of the carriages 20, 22 is used to synchronise the speed of the continuous sheet 26 with the tool cylinder 12 during cutting, printing or embossing. With such an arrangement the continuous sheet 26 is required to be slowed or reversed after cutting, printing or embossing in order for the required position of the continuous sheet 26 to be matched with the flexible plate 62 for the next cutting, printing or embossing cycle. Such an arrangement provides the ability to use a wider range of repeat lengths, i.e. a longer flexible plate 62 on the tool drum 12 so that the angle 68 is greater than 270°, but at a slower speed of production when compared to operation of the apparatus 10, 80 using both anvil cylinders 14, 16. With such a single anvil cylinder 14, 16 operation of the apparatus 10, 80 only one of the carriages 20, 22 is used to change the speed of the continuous sheet 26. When using the single anvil cylinder 14 the continuous sheet 26 may pass from the roller 23 of the first carriage, and then exit the apparatus 10 at a constant speed as shown at 48 so that the rollers 25, 38, 40, 16, 44, 46, 27 are bypassed by the continuous sheet 26. Alternatively the continuous sheet 26 may follow the path as shown in FIGS. 1 and 2. The use of only one anvil cylinder 14 to cut, print or emboss the continuous sheet 26 is another mode of operation of the apparatus 10, 80.

In all of the above embodiments it will be appreciated that the tool cylinder 12 has a constant speed of rotation during operation of the apparatus 10, 80 albeit that the constant speed can be set by an operator of the apparatus 10, 80. It is the constant speed of rotation of the tool cylinder 12 and the use of multiple anvil cylinders 14, 16 that provides the improved speed of cutting, printing or embossing of the continuous sheet 26. This arrangement together with the movable carriages 20, 22 to change the speed of the continuous sheet 26 which it is within the apparatus 10, 80 provides for a greater operational flexibility of the apparatus 10, 80 with the ability to utilise a single tool cylinder 12 having a variable length flexible plate 62 for cutting, printing or embossing of the continuous sheet 26.

The invention claimed is:

1. An apparatus for cutting, printing or embossing a continuous sheet, the apparatus comprising:

a tool element;

at least two anvils, which are co-operable with the tool element; and a phase adjustment device, wherein the tool element has a constant surface speed during operation of the apparatus, wherein the apparatus is adapted to receive the continuous sheet at a constant speed into the apparatus and is adapted to output the continuous sheet at a constant speed from the apparatus, wherein the phase adjustment device is operable to adjust a speed of the continuous sheet within the apparatus, the phase adjustment device comprising at least two carriages, each carriage being associated with a respective anvil, each carriage being movable with a drive device during operation of the apparatus to provide said adjustment of the speed of the continuous sheet, wherein each carriage has two rollers such that a respective portion of the continuous sheet is adapted to be between the two rollers of each carriage, each respective portion being adapted to pass between the tool element and the anvil associated with each carriage, and each carriage being movable to provide said adjustment of the continuous sheet by adjusting a speed of each respective portion in order to adjust a phase position of alternate parts of the continuous sheet to be cut, printed or embossed by each anvil as it co-operates with the tool element.

2. An apparatus according to claim 1, wherein the tool element is a tool cylinder, and/or wherein each anvil is an anvil cylinder.

3. An apparatus according to claim 1, wherein an intermediate roller arrangement is provided between adjacent carriages.

4. An apparatus according to claim 1, wherein each carriage is linearly movable between a first and second position.

5. An apparatus according to claim 4, wherein each carriage is horizontally linearly movable.

6. An apparatus according to claim 4, wherein the at least two carriages are linearly movable along a common axis.

7. An apparatus according to claim 1, wherein a laminate strip roller is provided between adjacent anvils, wherein a separate continuous laminate strip is receivable between each anvil and the tool element, the continuous laminate strip arranged to pass around the laminate strip roller, the continuous laminate strip having a laminate mounted thereon, each anvil being co-operable with the tool element to apply the laminate to alternate parts of the continuous sheet.

8. An apparatus according to claim 7, wherein the tool element is heated during application of the laminate onto the continuous sheet.

9. An apparatus according to claim 1, wherein the tool element is for mounting a tool plate thereon for cutting, printing or embossing the continuous sheet.

10. An apparatus according to claim 1, and further including more than two anvils, each anvil for cutting, printing or embossing a consecutive part of the continuous sheet.

* * * * *